United States Patent [19]

Thornton et al.

[11] 4,441,092

[45] Apr. 3, 1984

[54] VARIABLE INDUCTANCE WITH VARIABLE PICKOFF AND VARIABLE FLUX MEDIUM PERMEABILITY

[75] Inventors: Jack C. Thornton, Satellite Beach, Fla.; Randy G. Russell, Arlington Hts., Ill.

[73] Assignee: Rockwell International Corporation, El Segundo, Calif.

[21] Appl. No.: 373,946

[22] Filed: May 3, 1982

[51] Int. Cl.[3] ..... H01F 21/06

[52] U.S. Cl. ..... 336/130; 336/136; 336/137; 336/139; 336/141; 336/144; 336/149

[58] Field of Search ..... 336/130, 136, 137, 139, 336/141, 144, 149

[56] References Cited

U.S. PATENT DOCUMENTS 4,064,474 12/1977 Adams et al. ..... 336/139

FOREIGN PATENT DOCUMENTS 1020494 2/1953 France ..... 336/130

*Primary Examiner*—J. V. Truhe

*Attorney, Agent, or Firm*—Terry M. Blackwood; George A. Montanye; H. Fredrick Hamann

[57] ABSTRACT

A variable inductor includes a coil, a moveable contactor, and moveable magnetic material caused to move proximate the coil and simultaneously with the contactor. The contactor establishes first and second portions of the coil and, relative to the condition using no magnetic material, the inductance of the first portion is increased while the inductance of the second portion is substantially unchanged. Thus, over substantially all the tuning range, the first portion inductance is maintained greater than the second portion inductance.

11 Claims, 6 Drawing Figures

VARIABLE INDUCTANCE WITH VARIABLE PICKOFF AND VARIABLE FLUX MEDIUM PERMEABILITY

FIELD OF THE INVENTION

The present invention is generally related to variable inductance apparatus and more specifically to radio frequency or other tuneable electrical coils.

DESCRIPTION OF THE PRIOR ART

One common variable inductance electrical coil is the conventional and well-known roller or rotary coil. The roller coil comprises an electrical coil or solenoid plus a conductive roller or trolley wheel contactor supported on an electrically conductive guide or bar which extends the entire length of the coil. These and other existing high inductance coils are often restricted in the frequency range over which they are useable. Such restriction is due to the unused portion of the coil or solenoid going resonant at certain frequencies and causing a power loss in the active circuit. The high current generated in the resonant unused portion of the coil dissipate power and such dissipated power represents power that is not going to the load. Therefore, the load power drops off as the unused coil portion goes resonant. In addition, high voltages and currents are generated in the unused coil portion and these can damage the coil assembly due to voltage breakdown or excessive current heating. If a resonant frequency falls within the operating range of the circuit to be used, the coil may be practically useless unless something is done to correct the situation.

One prior art solution is to stop using the coil at some frequency and break up the unused portion resonances by putting multiple shorts onto and across appropriate sections of the unused coil portion. Quick connection shorting means (employing, for example, alligator chips) are typical of one approach. A somewhat more mechanized prior art approach has been to connect a plurality of wires to turns of the coil at various coil positions and to run all of these wires to one or more shorting switches.

Yet another prior art approach is shown in U.S. Pat. No. 3,958,196 assigned to the assignee of the present invention. Said patent shows a variable inductor having a non-rotating coil along with a sliding flexible conductive ribbon for shorting out selected turns of the coil. The tuning and shorting are stepped rather than continuous, the smallest tuning increment being one whole turn. The coil shown, like typical roller coils, is an air core coil.

In accordance with the present invention, these problems are addressed and resolved by variable inductor apparatus which features the provision of a moveable contactor and moveable magnetic material which cooperate to effect a substantially lower inductance in the unused coil portion than in the used coil portion. These and other features, objects, and advantages of the invention will become more apparent upon reference to the following specification, claims, and appended drawings in which:

BRIEF DESCRIPTION OF THE DRAWINGS

FIGS. *2a, 2b, 2c,* and *2d* are schematic representations of the presently preferred variable inductor embodiment in differently tuned conditions and further aid in explaining the principles of the present invention.

DESCRIPTION OF THE PREFERRED EMBODIMENT(S)

Figure 1:
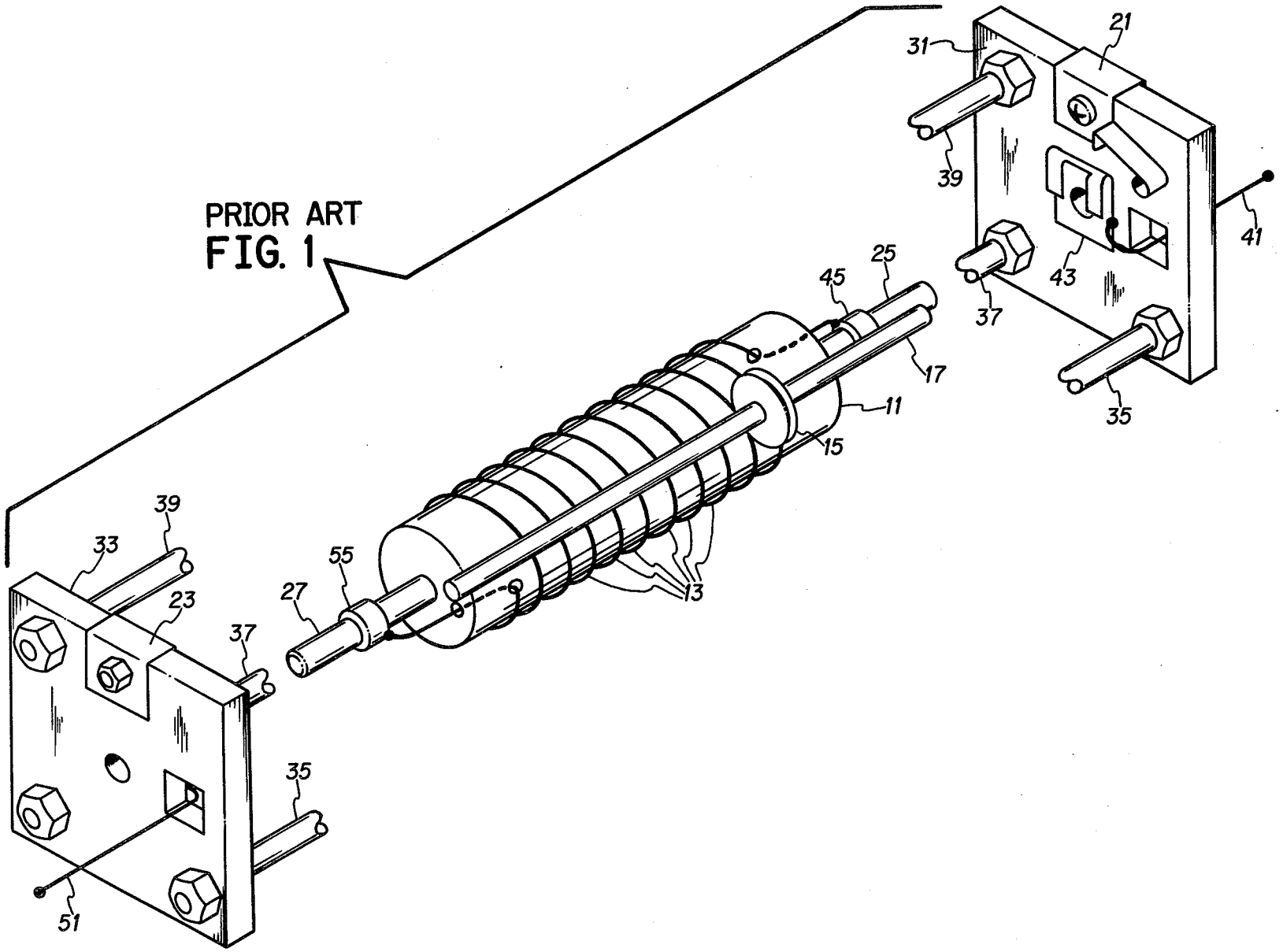
PRIOR ART FIG. 1
FIG. 1 is an exploded perspective view representing a prior art roller coil.

Turning now to FIG. 1, the conventional and familiar roller coil represented therein comprises a non-conductive cylindrical form 11 bearing a coil 13 of substantially helically wound bare conductive wire, and further comprises a trolley wheel contactor 15 carried by conductive guide 17. Trolley wheel contactor 15 is grooved or curved around its circumference so as to mate with or receive the coil wire. Guide 17 is held substantially parallel to the side of the coil by conductive spring-suspension mounts 21 and 23 which also serve as electrical terminals. Axially located shafts 25 and 27 protruding from the two form ends are journaled through openings in non-conductive end plates 31 and 33. Rods 35, 37 and 39 secure end plates 31 and 33 together and the secured plates hold the form and coil and allow rotation of the coil about its central axis.

Electrical connection or access to the far end of the coil is via electrical wire or terminal 41, brush 43, and slip ring 45. Electrical connection or access to the near end of the coil is via electrical terminal 51, brush 53 (not shown), and slip ring 55. Electrical connection or access to the roller/trolley wheel 15 and the point of the coil it touches is via either of mount-terminals 21 or 23, and via guide bar 17.

Trolley wheel 15 is free to turn about guide 17 and is also free to slide therealong. As the coil is rotated about its axis, the coil acts like a worm or screw and drives the wheel 15 along the guide 17. Thus, a variable inductance is available between either end of the coil and the trolley wheel contactor.

The resonance problem briefly mentioned hereinabove can arise in the following manner. Assume that terminal 41 (and thus the far end of the coil) is connected to RF and that the roller/trolley wheel 15 is the other side of the used portion of the coil. Further assume that the frequency of the RF is near the high end of an employed frequency range and that only a small part of the electrical coil is used. The illustrated tuning condition is representative of such assumption. Since most of the coil is unused (for the illustrated tuning condition) and since, in general, resonant frequency decreases as inductance value increases, the resonant frequency of the unused portion may well be too low to be compatible with the frequency for which the used portion is being used. If the user does not desire to replace the coil with a shorter one (i.e., one which would have less unused portion) then such user typically would effect a shorting between certain turns of the unused portion to increase the resonant frequencies of the unused portion. Such shorting as mentioned hereinabove can be accomplished in several ways.

Turning now to FIGS. *2a, 2b, 2c,* and *2d*, therein is schematically represented variable inductor apparatus which, over substantially all the tuning range, maintains the inductance of the unused coil portion low relative to the inductance of the used coil portion, and which thereby increases frequency of resonance of the unused portion to a frequency value well above the frequency of the circuit in which the used coil portion may be employed.

More particularly, an approximately cylindrical coil 113 comprises a used coil portion 113F and an unused portion 113K, a moveable contactor 115 demarcating the used and unused portions. The used coil portion 113F comprises the portion between the left end 141 of the coil and the moveable contactor 115. The unused coil portion 113K comprises the portion between the moveable contactor 115 and the right end 151 of the coil. The moveable contactor 115 is electrically conductive and is suitable for being moved along carrier means 117 to different locations on the coil 113 so as to provide electrical contact at the selected location on the coil.

Also included in a moveable, substantially cylindrical magnetic core 161 suitable for traveling axially within the interior of coil 113. Magnetic core 161 has a relative permeability greater than the relative permeability of air and is typically a ferrous material. In one extreme tuning position, no part of the core 161 is inside the coil 113, and instead, is located to the left of the coil. As moveable contactor 115 travels from the left end to the right end of the coil, the core 161 is simultaneously caused to travel further into the coil toward the right end of the coil. At the other extreme end of the tuning position, the core 161 is completely inside the coil 113.

The mechanical means causing moveable contactor 115 and core 161 to move simultaneously with one another is represented by dashed line 199. The moveable contactor and the right end of the coil are electrically shorted together by electrical connection 191.

Figure 2A:
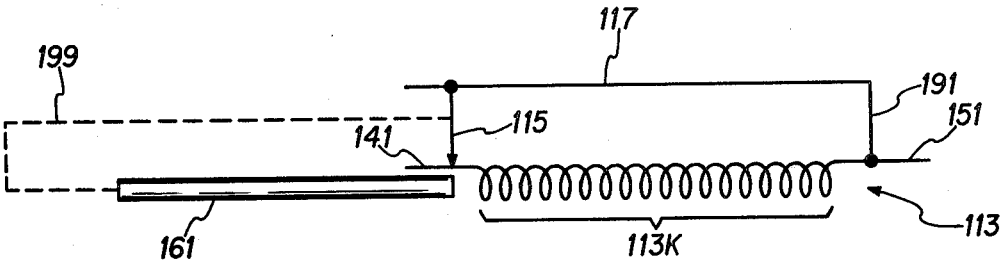
Figure 2B:
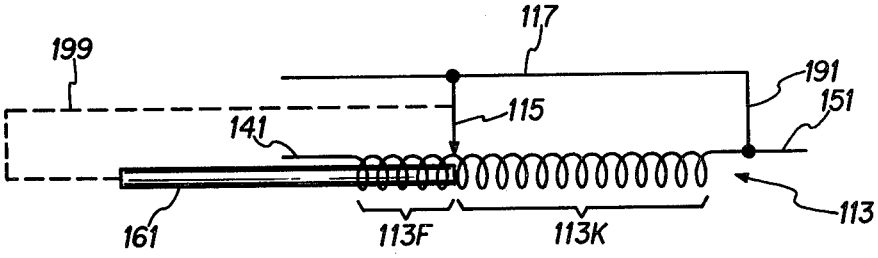

FIG. 2*a* represents one extreme tuning condition where all the coil is unused. In such condition, the moveable contactor 115 is located all the way to the left end of the coil and the core 161 is completely removed from the interior of the coil. FIG. 2*b* represents a tuning condition where most but not all of the coil 113 is unused and the balance of the coil is used. In such condition, the moveable contactor 115 is located less than half way between the left and right coil ends, and the core 161 has traveled toward the coil right end so as to enter the coil interior to a depth corresponding approximately to the length of the used coil portion 113F.

Figure 2C:
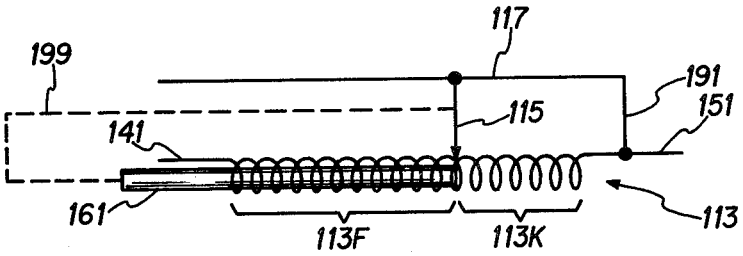
Figure 2D:
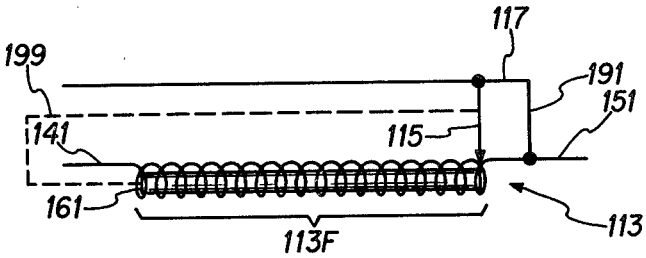

FIG. 2*c* represents a tuning condition where most but not all of the coil 113 is used and the balance of the coil is unused. In such condition, the moveable contactor 115 is located more than half way between the left and right coil ends and the core has traveled toward the coil right end so as to enter the coil interior to a depth corresponding approximately to the length of the used coil portion 113F. FIG. 2*d* represents the other extreme tuning condition, namely, the one where all the coil is used. In such condition, the moveable contactor is located all the way to the right end of the coil and the entire core is in the interior of the coil.

One effect of the magnetic material moving in proximity of the coil is to cause the used coil portion to have a substantially greater inductance than it would have had were the magnetic material not being used. Simultaneously, the unused coil portion is permitted to have an inductance not substantially different from what it would have had without the magnetic material being used.

It is presently preferred that the core be positioned relative to the moveable contactor such that the leading (i.e., right hand) end of the core 161 has substantially the same axial location as the moveable contactor. In this way the used coil portion maintains an internal flux carrying medium comprising magnetic material, and the unused coil portion maintains an internal flux carrying medium comprising air. It is further preferred that the core 161 be at least as long as the coil 113. In this way substantially all of the internal flux medium of the used coil portion is magnetic material, and substantially all the internal flux medium of the second coil portion is air.

Figure 3:
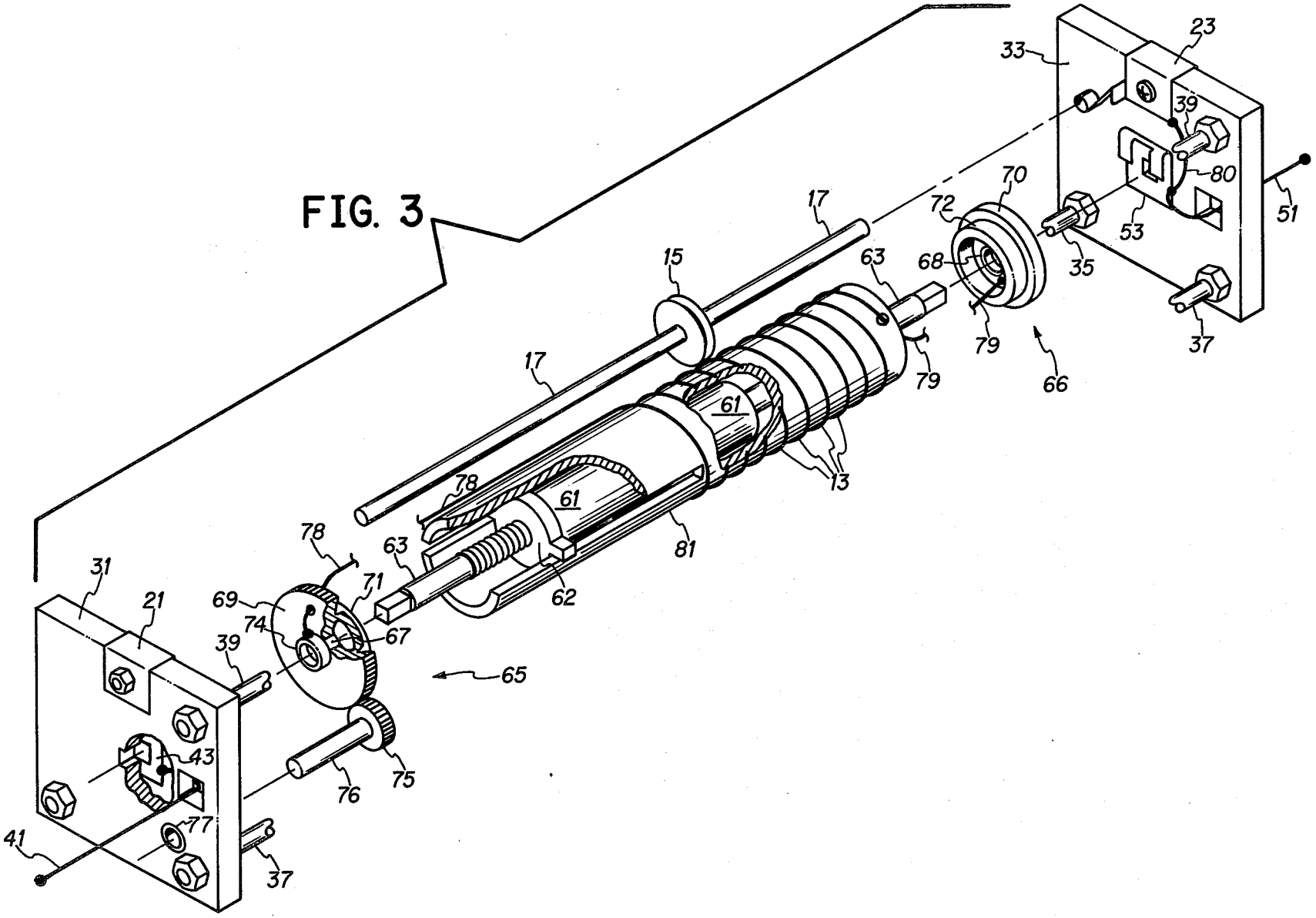
FIG. 3 is an exploded, partly cutaway, perspective view representing variable inductor apparatus incorporating the principles of the present invention.

Turning now to FIG. 3, therein is represented structure suitable for implementing the variable inductor apparatus schematically represented in FIGS. 2*a, b, c,* and *d*. The variable inductance apparatus represented in FIG. 3, although in accordance with the principles of the present invention, is similar in many respects to the FIG. 1 apparatus, and thus, in the interest of conciseness, rebundant explanation and description will be minimized or avoided where practical. Like designators are employed for like or similar elements in FIGS. 1 and 3.

To briefly preface more detailed description hereinbelow, rotation of coil 13 and form 81 causes trolley wheel contactor 15 to move or travel axially along conductive guide 17 due to coil 13 serving also as a mechanical worm. Internal of the form 81 is a core assembly which is capable of axial travel and which comprises a substantially cylindrical ferrous core 61 and internally threaded wing nut 62 to which one end of core 61 is secured. An axially extending hole running completely through the core assembly accommodates a stationary shaft 63 which is externally threaded over a length corresponding at least to the length of the axial travel desired of the core assembly. As the form 81 rotates, the core assembly is also caused to rotate because the wing nut tabs are captured by the axially running slits in the form, and thus, due to mechanical worm action between the core assembly and the shaft 63, the core assembly is caused to travel axially within the form.

More detailedly now, coil 13, comprising multiple turns of substantially helically wound bare conductive wire, is borne by a non-conductive, hollow, substantially cylindrical form 81 which is slit axially (i.e., lengthwise) on two opposing sides over about half the form length. Inside the form 81 is an axially moveable core assembly which comprises an internally threaded wing nut 62 and a substantially cylindrical ferrous core 61 secured at one end to the nut 62. Core 61 is substantially the same length as coil 13, and the form 81 is about twice the length of the coil 13. The outer diameter of core 61 is slightly less than the inner diameter of form 81. The core 61 material is typically carbonyl SF iron or carbonyl E iron and has a relative permeability of about 2 to 4.

The core assembly is supported by, and held in a form-coaxial location by, threaded shaft 63 which itself extends through an accommodating axially-directed hole in the core assembly and is secured and held stationary in end plates 31 and 33. The ears or tabs of nut 62 fit into the form slits and are captured thereby in the sense that the core assembly cannot freely rotate relative to form 81 and, instead, is caused to rotate therewith. The threads of the wing nut 62 and the threads of the shaft 63 are compatible with one another and, in the preferred embodiment, the number of threads per inch is selected to be the same as the number of turns per inch of the coil 13. Shaft 63 is threaded over a distance substantially corresponding to the length of the form slits. Although shaft 63 and wing nut 62 may be constructed of either conductive or non-conductive material, the presently preferred embodiment employs non-conductive material for both.

End cap assemblies 65 and 66 fit onto the two opposite ends of the form 81 and include axially located bearings 67 and 68 respectively so as to support the form coaxially about the shaft 63 and yet permit the form/coil combination to rotate freely about the stationary shaft 63. End cap assemblies 65 and 66 comprise disc-like elements 69 and 70, respectively, in which the bearings 67 and 68, respectively, are borne. Further included in the end cap assemblies 65 and 66, and secured coaxially to discs 69 and 70 are, respectively, tubular elements 71 and 72, the outer diameter of which substantially match the inner diameter of form 81. Similar slip rings 73 (not shown) and 74 may be secured coaxially to the end-plate sides of discs 69 and 70 respectively. Disc 69 may be toothed so as to constitute a gear for coupling with a second gear 75 and shaft 76 which, when journaled through a bearing 77 borne in end plate 31, permits tuning of the mechanism from a position at the front of the variable inductance apparatus. Discs 69 and 70, and tubular elements 71 and 72, are preferably constructed of non-conductive material such as Delrin Plastic.

Electrical connection or access to the near end of coil 13 is via electrical wire or terminal 41, brush 43, slip ring 74, and connection 78. Electrical connection or access to the far end of the coil 13 is via electrical terminal 51, brush 53, slip ring 73 (not shown), and connection 79. The near end of coil 13 is connected to slip ring 74 via conductive connection 78 extending along the bar portion of the form 81 and protruding through a hole in disc 69. The far end of coil 13 is connected to slip ring 73 (not shown) via conductive connection 79 passing to the interior of form 81 and then through a hole in disc 70.

The two ends of shaft 63 are inserted in accommodating openings in end plates 31 and 33 and the shaft is made stationary relative to end plates 31 and 33 by means such as flat sides on the shaft ends and corresponding flat sides in the end plate openings. Rods 35, 37, and 39 secure end plates 31 and 33 together.

A trolley wheel contactor 15 is carried by conductive guide 17 and is free to turn about and travel along guide 17. Guide 17 is held substantially parallel to the side of the coil 13 by conductive spring-suspension mounts 21 and 23, which also serve as electrical terminals. Contactor 15 is capable of maintaining continuous electrical contact with coil 13. Electrical connection or access to the trolley wheel contactor 15 and the point of the coil it touches is via either of mount-terminals 21 or 23, and via guidebar 17. In the preferred embodiment, terminals 23 and 51 are electrically shorted together by electrical connection 80.

For the FIG. 3 apparatus to have the same inductance range as the FIG. 1 apparatus (with a core), form 81 is made about twice as long as form 11 so as to accommodate an entire coil 13 length plus the entire core 61 length. Of course, the FIG. 3 items 17, 35, 37, and 39 are all elongated relative to their FIG. 1 counterparts so as to accommodate the elongated form.

In operation, the form 81 and coil 13 may be caused to rotate in unison by rotation of shaft 76. As the coil 13 rotates about its axis, the coil 13 acts like a worm or screw and drives trolley wheel contactor 15 along guide 17. Simultaneously, the rotating form 81 causes core assembly elements 61 and 62 to rotate about threaded stationary shaft 63. Due to mechanical worm action between threaded shaft 63 and nut 62, core 61 travels axially within the form 81 simultaneously with travel or contactor 15 along guide 17. Core 61 tracks the amount and direction of travel of wheel 15, and is positioned relative to wheel 15 such that the far end of core 61 maintains substantially the same axial location as wheel 15.

Various modifications are of course contemplated. For example, various core lengths and various position relationships between core and contactor may be acceptable and/or desirable in certain applications. Also, having moveable magnetic material proximate yet external the coil may be suitable in some applications. Of course, other mechanisms for simultaneously moving the core and contactor are envisioned. Merely further exemplary, suitable combinations of these modifications will yield additional variations.

Thus, while various embodiments of the present invention have been shown and/or described, it is apparent that changes and modifications may be made therein without departing from the invention in its broader aspects. The aim of the appended claims, therefore, is to cover all such changes and modifications as fall within the true spirit and scope of the invention.

What is claimed is:

1. A variable inductor comprising:

a coil comprising multiple turns of electrical conductor, said coil having first and second coil ends;

a moveable contactor comprising conductive means for electrically contacting said coil and suitable for being moved to one or more selectable locations on the coil so as to provide electrical contact at the selected location on the coil, said moveable contactor establishing first and second coil portions, the first coil portion comprising the portion of the coil between the first coil end and said moveable contactor, and said second coil portion comprising the portion of the coil between said moveable contactor and said second coil end;

magnetic material having relative permeability greater than the relative permeability of air, said material being located proximate said coil and being moveable;

means for causing said magnetic material to move simultaneously with location selection movement of said moveable contactor such that for each selected location of the contactor there is automatically effected a coordinated location of the magnetic material, the locations of contactor and material being coordinated so as to cause the first coil portion to have a substantially greater inductance than it would have were the magnetic material not proximate the coil, while permitting the second coil portion to have an inductance not substantially different from what it would have were the magnetic material not proximate the coil.

2. A variable inductor as defined in claim 1 and further including means for electrically shorting together said moveable contactor and said second coil end.

3. A variable inductor comprising:

a coil comprising multiple turns of electrical conductor wound to substantially follow a helical path, said coil being rotatable and having first and second coil ends;

a moveable contactor located exteriorly of said coil and comprising conductive means for continuously electrically contacting said coil one turn at a time and for traveling along a path substantially parallel to the side of said coil as the coil is rotated;

core means comprising magnetic material having relative permeability greater than the relative permeability of air, said core means being suitable for traveling interiorly of said coil;

means for causing said core means to travel simultaneously with travel of said moveable contactor such that, as said moveable contactor travels away from the first coil end and toward the second coil end, said core means, simultaneously therewith, travels further into said coil toward said second coil end.

4. A variable inductor as defined in claim 3 wherein said moveable contactor establishes first and second coil portions, the first coil portion comprising the portion of the coil between the first coil end and the moveable contactor, and said second coil portion comprising the portion of the coil between the moveable contactor and the second coil end;

and wherein said core means is positioned relative to said moveable contactor such that the first coil portion maintains an internal flux carrying medium comprising said magnetic material, and such that said second coil portion maintains an internal flux carrying medium comprising air.

5. A variable inductor as defined in claim 4 wherein said core means is configured such that substantially all of the internal flux medium of the first coil portion is magnetic material, and such that substantially all of the internal flux medium of the second coil portion is air.

6. A variable inductor as defined in claim 5 and further including means for electrically shorting together said moveable contactor and said second coil end.

7. A variable inductor as defined in claim 3, 4, 5, or 6 wherein said moveable contactor is driven along its path of travel by the coil as the coil rotates, whereby said coil serves substantially as a mechanical worm.

8. A variable inductor as defined in claim 3, 4, 5, or 6 wherein said moveable contactor is driven along its path of travel by the coil as the coil rotates, whereby said coil serves substantially as a mechanical worm, and wherein said moveable contactor comprises a wheel grooved around its circumference so as to be suitable for receiving and riding along the electrical conductor of the coil.

9. A variable inductor as defined in claim 3, 4, 5, or 6 wherein said core means includes an axis and a hole extending therethrough along said axis, said core means further including internal threads; and wherein said variable inductor further includes a hollow form upon which said coil is wound, said form having an axis substantially co-located with said core means axis, and said form being rotatable together with said coil and being suitable for allowing axial travel of the core means therethrough but not permitting the core means to rotate freely relative to the form; and wherein said variable inductor further includes a shaft located inside said core means, said shaft having external threads coupling with said core means internal threads, said shaft being stationary relative to the core means and the form, whereby, when said form and coil are rotated, said core means is also caused to rotate and thus, due to mechanical worm action between said stationary shaft and said core means, said core means is caused to travel axially inside said form.

10. A variable inductor as defined in claim 7 wherein said core means includes an axis and a hole extending therethrough along said axis, said core means further including internal threads; and wherein said variable inductor further includes a hollow form upon which said coil is wound, said form having an axis substantially co-located with said core means axis, and said form being rotatable together with said coil and being suitable for allowing axial travel of the core means therethrough but not permitting the core means to rotate freely relative to the form; and wherein said variable inductor further includes a shaft located inside said core means, said shaft having external threads coupling with said core means internal threads, said shaft being stationary relative to the core means and the form, whereby, when said form and coil are rotated, said core means is also caused to rotate and thus, due to mechanical worm action between said stationary shaft and said core means, said core means is caused to travel axially inside said form.

11. A variable inductor as defined in claim 8 wherein said core means includes an axis and a hole extending therethrough along said axis, said core means further including internal threads; and wherein said variable inductor further includes a hollow form upon which said coil is wound, said form having an axis substantially co-located with said core means axis, and said form being rotatable together with said coil and being suitable for allowing axial travel of the core means therethrough but not permitting the core means to rotate freely relative to the form; and wherein said variable inductor further includes a shaft located inside said core means, said shaft having external threads coupling with said core means internal threads, said shaft being stationary relative to the core means and the form, whereby, when said form and coil are rotated, said core means is also caused to rotate and thus, due to mechanical worm action between said stationary shaft and said core means, said core means is caused to travel axially inside said form.

* * * * *